US005577779A

United States Patent [19]

Dangel

[11] Patent Number: 5,577,779

[45] Date of Patent: Nov. 26, 1996

[54] SNAP FIT LOCK WITH RELEASE FEATURE

[75] Inventor: Tim M. Dangel, Commerce Township, Mich.

[73] Assignee: Yazaki Corporation, Tokyo, Japan

[21] Appl. No.: 361,974

[22] Filed: Dec. 22, 1994

[51] Int. Cl.[6] ..... E05C 19/06

[52] U.S. Cl. ..... 292/80; 292/DIG. 38; 220/326

[58] Field of Search ..... 292/80, 107, 19, 292/DIG. 16, DIG. 38; 220/326, 324; 215/237

[56] References Cited

U.S. PATENT DOCUMENTS

| | | | |
|---|---|---|---|
| 3,648,213 | 3/1972 | Kobler | 339/59 R |
| 3,971,613 | 7/1976 | Kobler | 339/69 R |
| 4,034,889 | 7/1977 | Hammes et al. | 220/324 X |
| 4,138,151 | 2/1979 | Nakao | 292/DIG. 38 X |
| 4,492,396 | 1/1985 | Lake et al. | 292/DIG. 38 X |
| 4,501,378 | 2/1985 | Berfield | 220/326 X |
| 4,582,219 | 4/1986 | Mortensen et al. | 220/326 |
| 4,746,008 | 5/1988 | Heverly et al. | 292/DIG. 38 X |
| 4,757,894 | 7/1988 | Schreckenstein | 292/DIG. 38 X |
| 4,890,742 | 1/1990 | Allison | 292/DIG. 38 X |
| 4,964,661 | 10/1990 | Cadwell et al. | 292/DIG. 38 X |
| 4,971,372 | 11/1990 | Gunderson | 292/DIG. 38 X |
| 5,100,015 | 3/1992 | Vanderstuyf | 292/DIG. 38 X |
| 5,123,541 | 6/1992 | Giannini et al. | 292/80 X |
| 5,126,510 | 6/1992 | Bauer et al. | 774/52.1 |
| 5,137,260 | 8/1992 | Pehr | 215/237 |
| 5,234,124 | 8/1993 | Buckner, III et al. | 220/326 |
| 5,515,240 | 5/1996 | Rocleffer et al. | 220/326 X |

FOREIGN PATENT DOCUMENTS

| | | |
|---|---|---|
| 217918 | 2/1990 | Japan . |
| 3-106816 | 3/1991 | Japan . |

*Primary Examiner*—Steven N. Meyers
*Assistant Examiner*—Monica E. Millner
*Attorney, Agent, or Firm*—Young & Basile, P.C.

[57] ABSTRACT

A snap fit locking mechanism is provided for releasably joining a pair of components. The locking mechanism contains a resilient locking arm integrally formed on a first component. The locking arm includes an outwardly extending projection which defines a step portion and a cam surface. A rigid rectangular locking frame extends outwardly from a second component and defines a substantially rectangular aperture adapted to receive and secure the locking arm. A resilient tab extends outwardly from the second component and into the locking frame aperture and is deflected upon insertion of the locking arm into the locking frame aperture. The resilient tab maintains the locking arm in a secure engagement with the locking frame.

8 Claims, 3 Drawing Sheets

FIG-5
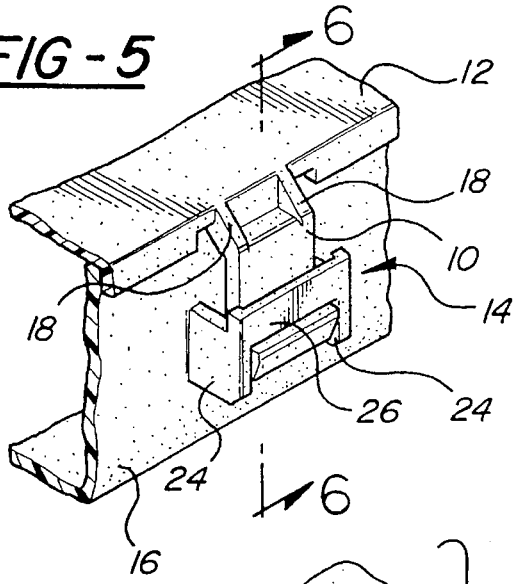
FIG-6
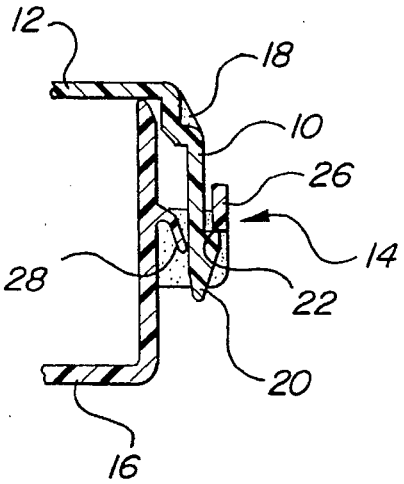
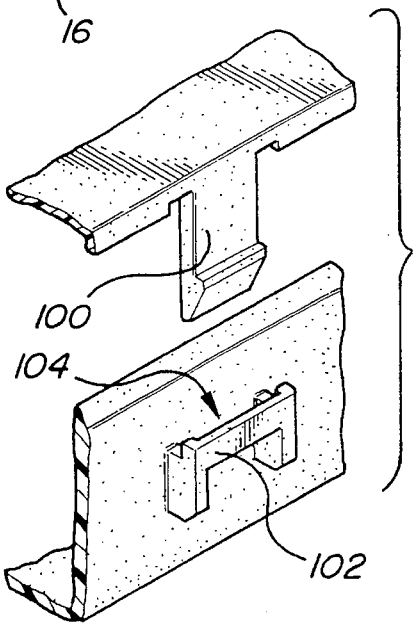
FIG-7
PRIOR ART
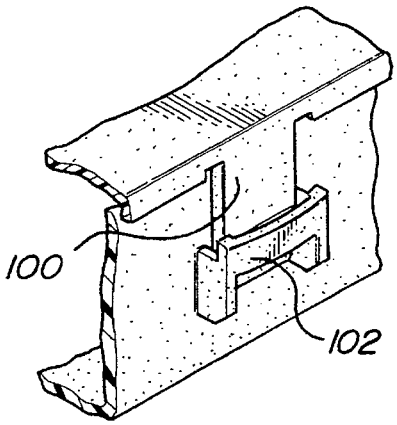
FIG-8
PRIOR ART
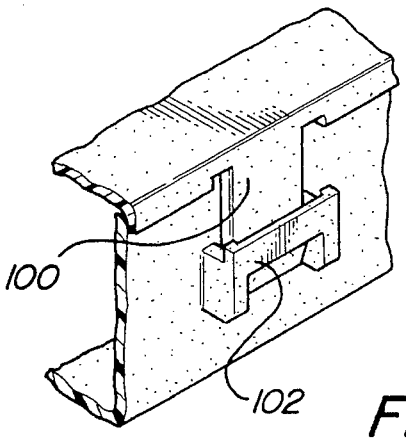
FIG-9
PRIOR ART

SNAP FIT LOCK WITH RELEASE FEATURE

FIELD OF THE INVENTION

The present invention relates to a snap fit locking mechanism for releasably joining two components.

BACKGROUND OF THE INVENTION

Various types of lock mechanisms are used to secure one component to another. Generally, each component contains a portion of the lock mechanism. These lock mechanisms can be difficult to release after they have been secured. Furthermore, attempting to release the lock mechanism can damage or destroy the lock, requiring replacement of one or both components.

One such prior art lock mechanism is shown in FIGS. 7–9. This bayonet-type lock mechanism has a male portion 100 on one component which engages a female portion 102 on a second component. As shown in FIG. 8, female portion 102 is deformed outwardly as male portion 100 is inserted into slot 104. After male portion 100 is inserted, female portion 104 returns to its original shape, as shown in FIG. 9.

To release the lock mechanism illustrated in FIGS. 7–9, the lock is generally damaged or destroyed. The female portion must be deformed using a flat blade tool, causing the lock mechanism to stretch or break. Even if the lock mechanism is not destroyed when released, the female portion can become substantially deformed such that it loses the ability to securely retain the male portion. The flat-blade tool may also damage the male portion, thereby reducing performance of the lock mechanism. Since the lock mechanism is integrally formed on each component, damage to the lock mechanism may require replacement of one or both of the components.

Furthermore, if the lock mechanism is located in a confined area, it may be difficult to manipulate the flat-blade tool to release the lock. Therefore, this prior art lock mechanism is not suited for installations requiring repeated engagement and release.

SUMMARY OF THE INVENTION

The present invention provides a snap fit lock mechanism for releasably joining two molded plastic components. The lock mechanism can be engaged and released without the use of tools. Thus, the lock mechanism may be released in the field or by an operator who does not have access to any tools. Also, the lock mechanism can be located in a confined area where manipulation of a tool is difficult. Releasing the lock mechanism is easily done by hand and does not damage or deform the lock structure. Therefore, the inventive lock mechanism may be repeatedly secured and released without reducing the retention performance of the lock.

The lock mechanism may be used to join various types of components, such as wiring harness shields, connectors, covers, and retaining clips. Any number of lock mechanisms can be used to join a pair of components. The number of lock mechanisms used will vary depending on the size and type of components being joined. For example, a small, hinged retaining clip may only require a single lock mechanism whereas a large wiring harness shield may require six or more lock mechanisms.

The snap fit lock mechanism includes a resilient locking arm integrally molded to a first component and a rigid locking frame integrally molded to a second component. The locking arm includes a projection which defines a step portion and a cam surface. The locking frame has a generally rectangular shape and defines a generally rectangular aperture which is adapted to receive the locking arm. An integral resilient tab extends outwardly from the second component and into the locking frame aperture. The resilient tab is capable of being deflected by insertion of the locking arm into the locking frame aperture and maintains a secure engagement between the locking arm and locking frame.

In the preferred form, the locking frame aperture is larger than the locking arm projection, permitting insertion of the locking arm without deforming the locking frame. Furthermore, the step portion of the locking arm projection engages the locking frame to secure the first component to the second component.

Preferably, the locking frame includes a pair of parallel, spaced apart side supports which extend perpendicularly from the second component. A crossmember is attached to and extends between the distal ends of the side supports.

In operation, the first and second components are joined together by first aligning the components such that each locking arm aligns with the corresponding locking frame aperture. As the two components are urged together, the locking arm enters the locking frame aperture. As the locking arm projection contacts the frame, the locking arm is deflected toward the second component. As the locking arm continues, the resilient tab is also deflected toward the second component, allowing the locking arm to pass. When the locking arm projection has passed the locking frame, the locking arm returns to its original shape, causing the locking arm projection to engage the frame. The engagement between the locking arm projection and the frame secures the first component to the second component. The resilient tab provides a constant force, urging the locking arm toward the locking frame, thereby maintaining a secure locking engagement between the locking arm projection and the frame, preventing accidental disengagement.

To release the locking mechanism, the locking arm is urged toward the second component, causing the locking arm and the resilient tab to deflect toward the second component. The deflection of the locking arm causes the locking projection to disengage the locking frame, allowing the locking arm to be pulled from the aperture, thereby releasing the lock mechanism. As the locking arm is removed from the aperture, the resilient tab returns to its original shape.

The locking mechanism may be repeatedly engaged and released without damaging or deforming the locking structure. Repeated engagement and release of the locking mechanism does not diminish its ability to securely join the two components.

BRIEF DESCRIPTION OF THE DRAWINGS

FIG. 5 is a perspective view of the snap fit lock mechanism in the locked position;

FIG. 6 is a cross-sectional view of the snap fit lock mechanism in the locked position;

FIG. 7 is a perspective view of a prior art lock mechanism in the released position;

FIG. 8 is a perspective view of the prior art lock mechanism partially engaged;

FIG. 9 is a perspective view of the prior art lock mechanism in the locked position;

DETAILED DESCRIPTION OF THE PREFERRED EMBODIMENT

Figure 1:
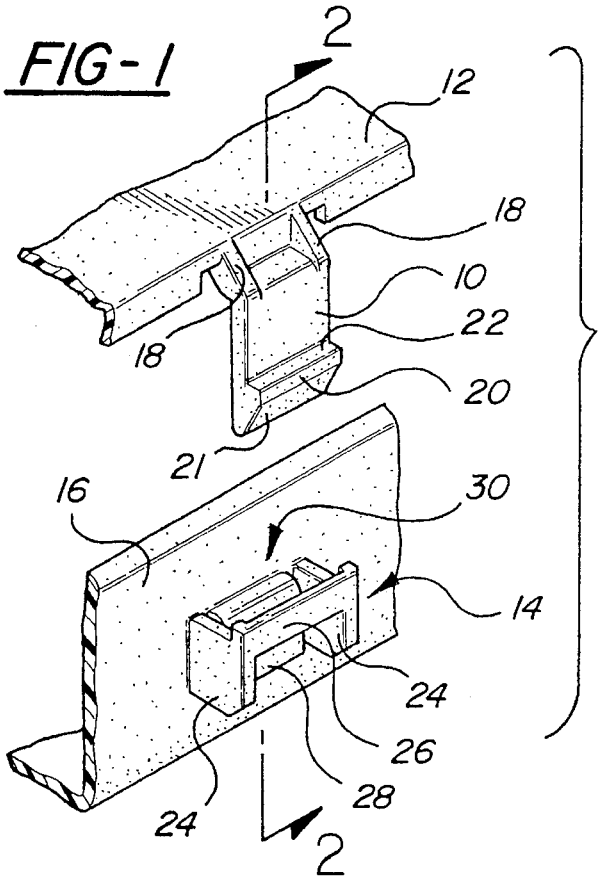
FIG. 1 is a perspective view of the snap fit lock mechanism in the released position.

Referring to FIG. 1, a first component 12 is releasably joined to a second component 16 using a snap fit lock mechanism. In the preferred embodiment, components 12, 16 and the lock mechanism components are molded from a plastic material such as polypropylene. A resilient locking arm 10 is integrally molded to first component 12. A pair of support ribs 18 are located between locking arm 10 and first component 12 to strengthen the attachment of the locking arm to the first component. Locking arm 10 includes a projection 20 integrally molded to the front side of the locking arm adjacent the distal end thereof. Projection 20 defines a step portion 22 located near the end of locking arm 10. Projection 20 includes a cam surface 21 located between step 22 and the distal end of locking arm 10.

A locking frame 14 is integrally molded to second component 16. Locking frame 14 contains a pair of parallel, spaced apart side supports 24 which extend perpendicularly from second component 16, and a crossmember 26 which is attached to the distal end of each side support 24. In the preferred form, locking frame 14 has a generally rectangular shape and defines a generally rectangular aperture 30 which is capable of receiving locking arm 10. Preferably, aperture 30 has dimensions which are slightly larger than the dimensions of projection 20 on locking arm 10, allowing the locking arm to pass through the aperture without deforming locking frame 14. Further, step 22 is engageable with crossmember 26 when locking arm 10 is fully inserted into aperture 30, thereby securing the locking arm within the locking frame.

Although an embodiment of locking frame 14 has been described as rectangular, it will be understood that other shapes may be used depending on the shape of locking arm 10, including, but not limited to, a square, triangular, or semi-circular locking frame. The shape of aperture 30 may vary depending on the shape of locking frame 14.

Figure 2:
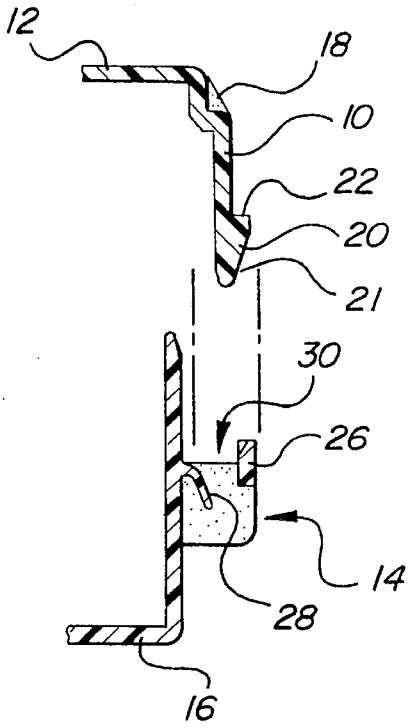
FIG. 2 is a side cross-sectional view of the snap fit lock mechanism in the released position.

Referring to FIG. 2, a resilient tab 28 is integrally molded to second component 16. Tab 28 extends outwardly from second component 16 and into aperture 30. The resiliency of tab 28 allows the tab to deflect toward second component 16 when locking arm 10 is inserted into aperture 30.

The snap fit lock mechanism has a released position, shown in FIGS. 1 and 2, and a locked position, shown in FIGS. 5 and 6. In the released position, first component 12 and second component 16 are separated and the lock mechanism is not engaged. In the locked position, first component 12 is joined to second component 16 and the lock mechanism is engaged.

In operation, first component 12 is joined to second component 16 by positioning the two components such that locking arm 10 aligns with aperture 30. If components 12 and 16 have more than one lock mechanism, the components are positioned such that all locking arms 10 align with all corresponding apertures 30. FIGS. 1 and 2 illustrate the proper alignment of locking arm 10 with locking frame 14.

Figure 3:
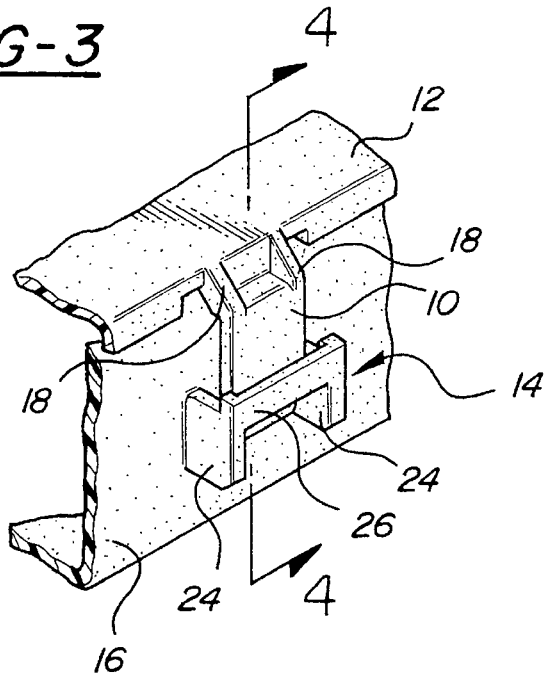
FIG. 3 is a perspective view of the locking arm partially engaging the locking frame.
Figure 4:
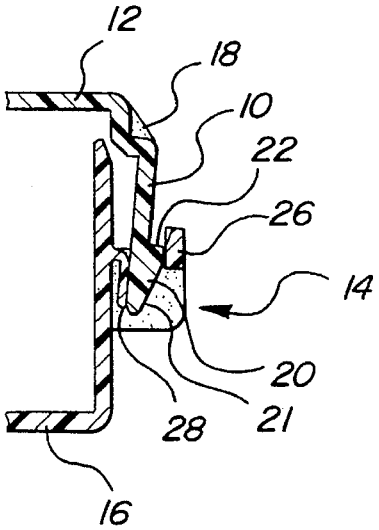
FIG. 4 is a side cross-sectional view of the locking arm partially engaging the locking frame.

Referring to FIGS. 3 and 4, first component 12 is secured to second component 16 by urging the two components toward one another. As locking arm 10 enters aperture 30, cam surface 21 on projection 21 contacts crossmember 26, causing the locking arm to deflect toward second component 16. Simultaneously, the back side of locking arm 10, i.e., the side opposite projection 20, contacts resilient tab 28, causing the tab to deflect toward second component 16.

As locking arm 10 continues into aperture 30, cam surface 21 slides along crossmember 26 thereby further deflecting the locking arm, and the locking arm slides along tab 28 thereby further deflecting the tab. As shown in FIGS. 5 and 6, when projection 20 passes crossmember 26, locking arm 10 returns to its original shape, causing step 22 to interact with crossmember 26. The interaction between step 22 and crossmember 26 secures locking arm 10 to frame 14, and thereby secures first component 12 to second component 16.

After projection 20 passes crossmember 26 and returns to its original shape, tab 28 substantially returns to its original shape, but remains in contact with the back side of locking arm 10. Since locking arm 10 is located in aperture 30, tab 28 cannot completely return to its original shape and, therefore, continues to press against the back side of locking arm 10. The urging of tab 28 against locking arm 10 urges the locking arm toward crossmember 26. This interaction between tab 28 and locking arm 10 prevents inadvertent release of the locking arm from crossmember 26.

To release the lock mechanism, locking arm 10 is urged toward second component 16, causing the locking arm to deflect toward the second component. As locking arm 10 deflects toward second component 16, tab 28 also deflects toward the second component. As locking arm 10 is deflected, step 22 slides along crossmember 26. When step 22 moves past crossmember 26, locking arm 10 can be removed from locking frame 14 by pulling the two components 12, 16 away from each other. After locking arm 10 has been removed from locking frame 14, locking arm 10 and resilient tab 28 return to their original shapes.

The snap fit lock mechanism may be repeatedly engaged and released without sacrificing the ability of the lock mechanism to securely join the two components. Furthermore, the lock mechanism can be engaged and released without the use of tools. A user can release the lock mechanism by simply pressing on projection 20 and pulling the two components 12, 16 apart. The snap fit lock mechanism may be used to join various types of components including, but not limited to, wiring harness shields, retaining clips, connectors, and covers for other devices. Additionally, since the snap fit lock mechanism has a unitary structure, the mechanism can be molded to each component in a single operation and does not contain loose pieces which may be lost or misplaced.

The above description of the lock mechanism focuses on a single lock mechanism. However, it will be understood that many applications will require more than one lock mechanism. For example, large components may require considerably more lock mechanisms than small components. A two-piece wiring harness cover may require eight or more lock mechanisms positioned on the peripheral edges of the cover pieces whereas a hinged retaining clip may require only one lock mechanism. The quantity and positioning of the lock mechanisms for a particular application will be apparent to those skilled in the art.

If more than one lock mechanism is used, each lock mechanism will conform to the description as set forth above. An example of an apparatus containing multiple lock mechanisms is shown in FIGS. 10 and 11 using four locking arms 10 (two on each side) which register with four corresponding locking frames 14 (two on each side).

Figure 10:
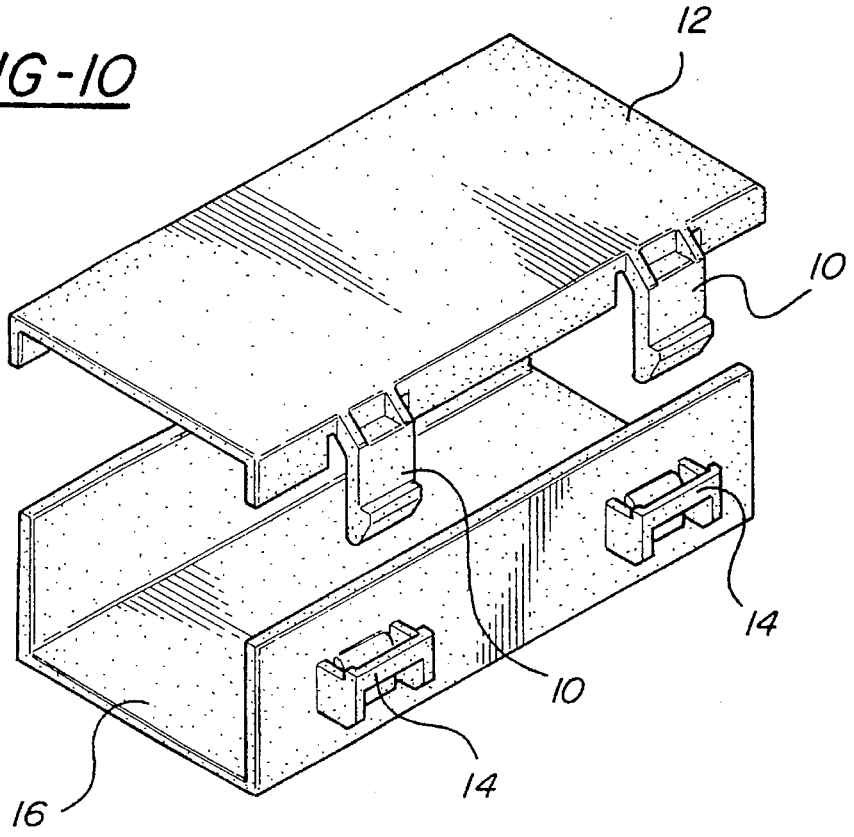
FIG. 10 is a perspective view of a pair of components having a plurality of snap fit lock mechanisms, in the released position.
Figure 11:
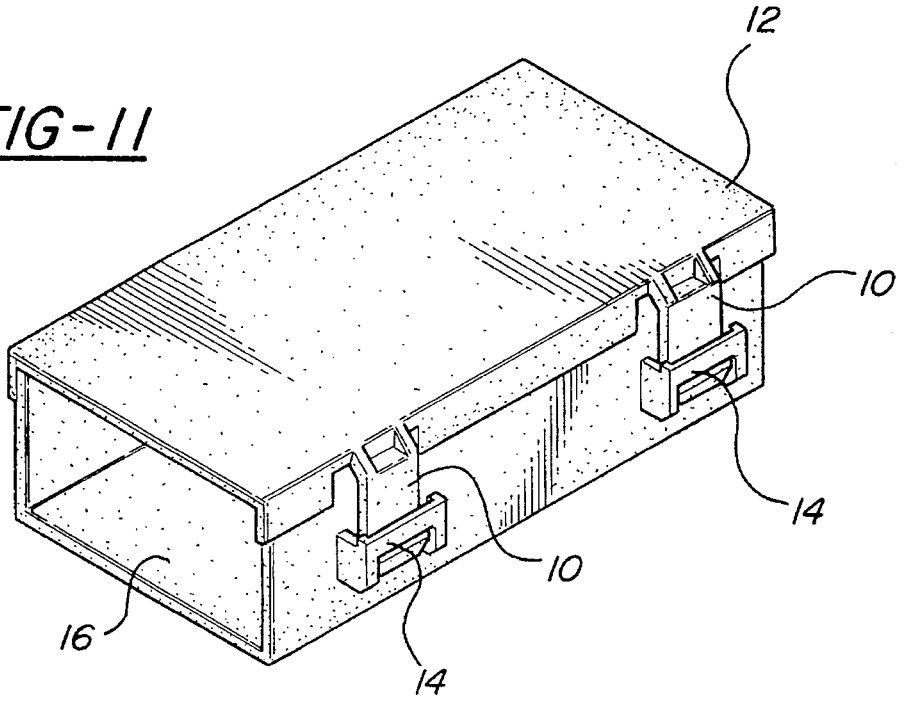
FIG. 11 is a perspective view of a pair of components having a plurality of snap fit lock mechanisms, in the locked position.

In operation, the two components 12, 16 are aligned as shown in FIG. 10 such that all locking arms 10 align with all corresponding locking frames 14. The two components 12, 16 are then urged together following the same procedures described above. Each locking arm 10 enters the corresponding aperture 30, causing the locking arm to deflect. Simultaneously, each resilient tab 28 is deflected toward second component 16 by contact with the back side of its respective locking arm. As each locking arm projection 20 passes the corresponding crossmember 26, locking arms 10 return to their original shape, engaging the crossmember as shown in FIG. 11. Each locking arm 10 is held in locking engagement with each crossmember 26 by the corresponding resilient tab 28.

To release components 12 and 16, each locking arm 10 is disengaged from corresponding locking frame 14, and the two components are pulled apart.

I claim:

1. First and second components in combination with a lock mechanism which releasably secures said first and second components together, said lock mechanism comprising:

a resilient locking arm integrally formed on said first component and extending therefrom, said locking arm having a first side and an opposite second side and a projection extending outwardly from the first side and defining a step portion and a cam surface;

a rigid locking frame integrally formed on and extending outwardly from said second component, said locking frame having a generally rectangular shape and defining a generally rectangular aperture adapted to receive said locking arm in a releasable, securing engagement; and an integral resilient tab extending outwardly from said second component and into said locking frame aperture, said resilient tab contacting said second side of said locking arm and urging said projection toward securing engagement with said locking frame when said locking arm is inserted into said locking frame.

2. The apparatus of claim 1 wherein said step portion of said locking arm engages said locking frame to secure said first component to said second component.

3. The apparatus of claim 1 wherein said locking frame aperture is larger than said locking arm projection permitting said locking arm projection to pass therethrough without deforming said locking frame.

4. The apparatus of claim 1 wherein said locking frame includes a pair of parallel, spaced apart side supports extending perpendicularly from said second component, and a crossmember attached to the distal end of each side support and extending therebetween.

5. The apparatus of claim 4 wherein said resilient tab is positioned between said pair of side supports.

6. The apparatus of claim 4 wherein said cam surface operatively interacts with said crossmember to deflect said locking arm toward said second component.

7. First and second components in combination with a lock mechanism which releasably secures said first and second components together, said lock mechanism comprising:

a resilient locking arm integrally formed on said first component and extending therefrom, said locking arm having a first side and an opposite second side and a projection extending outwardly from said first side and defining a step portion and a cam surface;

a rigid locking frame extending outwardly from said second component, said locking frame having a pair of parallel, spaced apart side supports extending perpendicularly from said second component and a crossmember attached to the distal end of each side support and extending therebetween, said crossmember operatively interacting with said cam surface to deflect said locking arm toward said second component; and a resilient tab extending outwardly from said second component and into said locking frame to contact said second side of said locking arm and urge said locking arm outwardly toward said crossmember when said locking frame and said locking arm are engaged.

8. First and second components in combination with a lock mechanism which releasably secures said first and second components together, said lock mechanism comprising:

a plurality of resilient locking arms integrally formed on said first component and extending therefrom, each locking arm having a first side and an opposite second side and a projection extending outwardly from the first side and defining a step portion and a cam surface;

a plurality of rigid locking frames integrally formed on and extending outwardly from said second component, each locking frame having a generally rectangular shape and defining a generally rectangular aperture adapted to receive one of said locking arms in a releasable, securing engagement, said locking frames registrable with said locking arms; and a plurality of integral, resilient tabs extending outwardly from said second component and into said locking frame apertures, each resilient tab contacting said second side of said locking arm and urging said projection toward securing engagement with said locking frame when said locking arm is inserted into said locking frame.

* * * * *